US010431414B2

(12) United States Patent
Cheng

(10) Patent No.: US 10,431,414 B2
(45) Date of Patent: Oct. 1, 2019

(54) COMPOSITE TARGET AND X-RAY TUBE WITH THE COMPOSITE TARGET

(71) Applicant: NanoRay Biotech Co., Ltd., New Taipei (TW)

(72) Inventor: Chi-Chieh Cheng, Taipei (TW)

(73) Assignee: NanoRay Biotech Co., Ltd., Taipei (TW)

( * ) Notice: Subject to any disclaimer, the term of this patent is extended or adjusted under 35 U.S.C. 154(b) by 452 days.

(21) Appl. No.: 15/131,039

(22) Filed: Apr. 18, 2016

(65) Prior Publication Data

US 2017/0018392 A1 Jan. 19, 2017

Related U.S. Application Data

(60) Provisional application No. 62/148,755, filed on Apr. 17, 2015.

(51) Int. Cl.

| | |
|---|---|
| ***H01J 35/00*** | (2006.01) |
| ***H01J 35/08*** | (2006.01) |
| ***H01J 35/14*** | (2006.01) |
| ***G21K 1/10*** | (2006.01) |

(52) U.S. Cl.

CPC ..... *H01J 35/08* (2013.01); *G21K 1/10* (2013.01); *H01J 35/14* (2013.01); *H01J 35/116* (2019.05); *H01J 2235/08* (2013.01); *H01J 2235/081* (2013.01); *H01J 2235/083* (2013.01); *H01J 2235/086* (2013.01); *H01J 2235/088* (2013.01)

(58) Field of Classification Search

CPC ..... H01J 2235/081; H01J 2235/083; H01J 2235/086; H01J 2235/087; H01J 2235/08; H01J 2235/088

See application file for complete search history.

(56) References Cited

U.S. PATENT DOCUMENTS

2008/0084966 A1* 4/2008 Aoki ..... G01N 23/223 378/140
2013/0308754 A1* 11/2013 Yamazaki ..... H01J 35/08 378/62
2014/0086388 A1* 3/2014 Yamada ..... H01J 35/24 378/62

* cited by examiner

*Primary Examiner* — Dani Fox
(74) *Attorney, Agent, or Firm* — JCIPRNET

(57) ABSTRACT

A composite target is provided and is interacted with an electron to generate an X-ray, and an energy of the electron can be changed by controlling a tube voltage at least. The composite target includes a target body and an interposing layer which is connected with the target body. The interposing layer moves a highest peak of an energy spectrum of the X-ray toward a high energy direction. The interposing layer may be a single metal or a metal mixture. Not only a low energy photon of the X-ray can be filtered by the interposing layer, but also a distribution of the low energy photon of the X-ray can be increased by increasing a thickness of the interposing layer. As the tube voltage is enhanced, an amount of a high energy photon of the X-ray generated is dramatically increased. An X-ray tube containing the above composite target is also provided.

29 Claims, 18 Drawing Sheets

COMPOSITE TARGET AND X-RAY TUBE WITH THE COMPOSITE TARGET

CROSS-REFERENCE TO RELATED APPLICATION

This application claims the priority benefits of U.S. provisional application Ser. No. 62/148,755, filed on Apr. 17, 2015. The entirety of the above-mentioned patent application is hereby incorporated by reference herein and made a part of specification.

BACKGROUND OF THE INVENTION

Field of the Invention

The invention relates to a target and an X-ray tube, and particularly relates to a composite target and an X-ray tube with the composite target.

Description of Related Art

An X-ray tube can be broadly divided into a transmission type X-ray tube and a reflection type X-ray tube, which is suitable for medical image, industrial testing, and other technical fields.

FIG. 1 is a schematic diagram of a conventional transmission type X-ray tube. Referring to FIG. 1, a transmission type X-ray tube 100 includes a cathode 110, a focusing mechanism 120, an end window anode 130, a target 140, a power source supply 150, and a vacuum casing 160. An electron from the cathode 110 is accelerated along an electron beam path 170, so as to hit the target 140 to generate an X-ray 180.

Referring to FIG. 1, the focusing mechanism 120 is used to focus on the electron, so as to control the position where the electron hits the target 140. The power source supply 150 is connected between the cathode 110 and the end window anode 130 to provide the energy for the electron, so as to accelerate the electron. The generated X-ray 180 penetrates through the end window anode 130 and emits to the outside of the vacuum casing 160.

FIG. 2 is a schematic diagram of a conventional reflection type X-ray tube. Referring to FIG. 2, a reflection type X-ray tube 200 includes a cathode 210, an anode 220, a power source supply 230, a side window 240, and a vacuum casing 250. An electron from the cathode 210 is accelerated along an electron beam path 260, so as to hit the target (not shown) contained on the anode 220, thereby generating an X-ray 270 at the anode 220.

Referring to FIG. 2, the power source supply 230 is connected between the cathode 210 and the anode 220 to provide the energy for the electron, so as to accelerate the electron. The generated X-ray 270 is reflected toward the side window 240 at the anode 220, and then emits to the outside of the vacuum casing 250.

The transmission type X-ray tube 100 using the conventional single target as shown in FIG. 1 has the following issues which are illustrated by FIG. 3.

FIG. 3 illustrates an output spectrum of a transmission type X-ray tube. In FIG. 3, a fixed tube voltage of 120 kV is used. It shows the relationship between the energy band of the X-ray photon on the horizontal axis and the amount of the X-ray photon on the vertical axis under the condition that tantalum with different thickness (13 μm, 50 μm, and 100 μm) is used as the target.

Referring to FIG. 3, it can be learned that each target with different thickness (13 μm, 50 μm, and 100 μm) has different bremsstrahlung distribution. When it is desired to use different bremsstrahlung distribution, it is required to correspondingly replace the target with different thickness, so that the use is quite inconvenient.

The amount of the X-ray photon of the conventional transmission type X-ray tube can be adjusted by using the methods such as adjusting the thickness, tube voltage, and tube current of the target. However, it is still difficult to obtain the required X-ray energy spectrum distribution.

The reflection type X-ray tube 200 as shown in FIG. 2 has the following issues which are illustrated by FIG. 4. FIG. 4 is a diagram illustrating the comparison between an output spectrum of a transmission type X-ray tube and an output spectrum of a reflection type X-ray tube. The transmission type X-ray tube uses tantalum with a thickness of 25 μm as the target, and a filter layer is not provided; and the reflection type X-ray tube uses tungsten (W)+aluminum (Al) (1.6 mm) as the target. In FIG. 4, the horizontal axis represents the energy band of the X-ray photon, and the vertical axis represents the amount of the X-ray photon. Also, FIG. 4 shows the distribution of the X-ray photon of the two when the tube voltage is set at 120 kV.

Referring to FIG. 4, at the same tube voltage (120 kV), the amount of the high energy photon of the X-ray of the reflection type X-ray tube is far more than the amount of the high energy photon of the X-ray of the transmission type X-ray tube. For the reflection type X-ray tube, the energy spectrum distribution ratio can be changed by increasing the tube voltage. Corresponding to the object with different thickness, the number of the X-ray photon which can penetrate the object to be tested can be increased by changing the tube voltage, so as to improve the image contrast ratio.

However, as shown in FIG. 4, the amount of the low energy photon of the X-ray of the reflection type X-ray tube is usually too much, which causes unnecessary radiation absorbed dose for human body.

Additionally, if the target is bombarded by the electron for a long time, the loss of the surface material of the target is generated. Also, since the target is hit by the electron, it becomes a high-temperature target, and the temperature which is close to the melting temperature of the target is often achieved. Thus, the target is subjected to high evaporation rate at the melting temperature, so as to shorten the life of the target.

SUMMARY OF THE INVENTION

In view of this, the invention provides a composite target, which can generate a variety of X-ray energy spectrum distributions and with a sufficient long service life.

The invention provides an X-ray tube with the above composite target, which can provide a variety of X-ray energy spectrum distributions and with a sufficient long service life.

Based on the above, the invention provides a composite target interacted with an electron to generate an X-ray, and an energy of the electron can be changed by controlling a tube voltage at least. The composite target includes a target body and an interposing layer. The interposing layer is connected with the target, wherein the interposing layer moves a highest peak of an energy spectrum of the X-ray toward a high energy direction, and a low energy photon of the X-ray is filtered by the interposing layer. Also, the low energy photon of the X-ray can be increased by increasing a thickness of the interposing layer. As the tube voltage is enhanced, an amount of a high energy photon of the X-ray generated is increased.

The invention also provides an X-ray tube including a casing, an anode, a cathode, and a power source. The anode is disposed at the casing, and a composite target is disposed on the anode. The composite target is interacted with an electron to generate an X-ray, and an energy of the electron can be changed by controlling a tube voltage at least. The composite target includes a target body and an interposing layer. The interposing layer is connected with the target body, wherein the interposing layer moves a highest peak of an energy spectrum of the X-ray toward a high energy direction, and a low energy photon of the X-ray is filtered by the interposing layer. Also, the low energy photon of the X-ray can be increased by increasing a thickness of the interposing layer. As the tube voltage is enhanced, an amount of a high energy photon of the X-ray generated is increased. The cathode is disposed in the casing to provide the electron. The power source is connected between the cathode and the anode.

Based on the above, the composite target of the invention has the interposing layer. By the interaction between the electron and the target body and between the electron and the interposing layer, and the interaction generated from the X-ray and the interposing layer, the X-ray energy spectrum distribution can be changed. Also, by the protective layer which can protect the composite target from excessive bombardment of the electron, the composite target has a sufficient long life. Additionally, by the setting method of a plurality of film layers of the target body and by changing the position where the electron enters the target, the X-ray with a designated energy spectrum distribution can be chosen.

In order to make the aforementioned features and advantages of the disclosure more comprehensible, embodiments accompanied with figures are described in detail below.

DESCRIPTION OF THE EMBODIMENTS

The composite target and the X-ray tube with the composite target provided by the invention can provide a variety of X-ray energy spectrum distributions to meet various actual needs. Embodiments of the invention are illustrated referring to the following figures.

Figure 5:
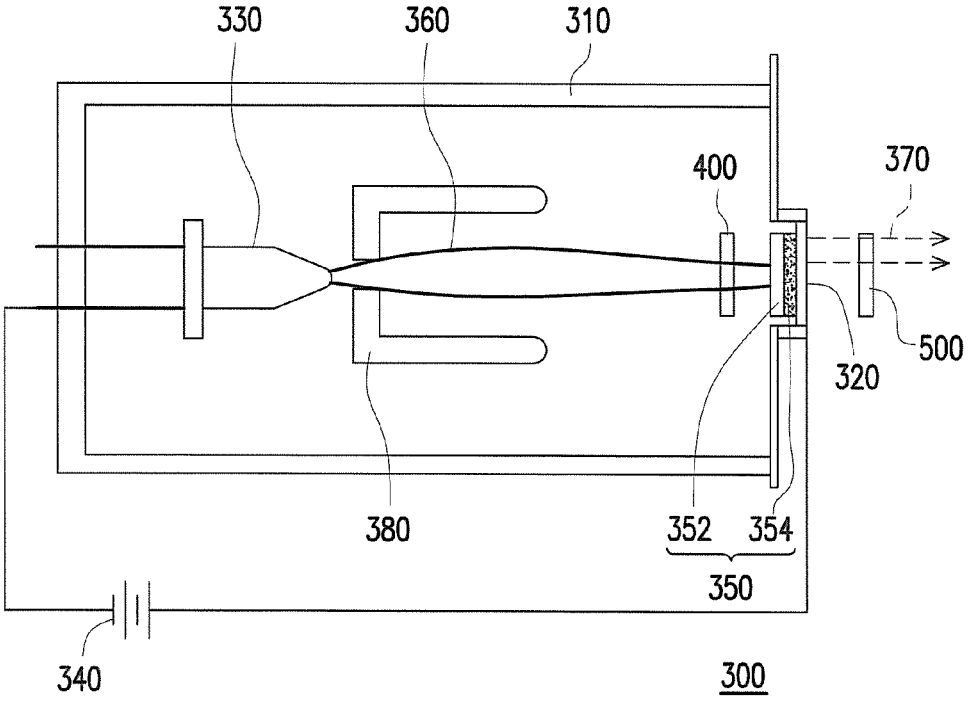
FIG. 5 is a schematic diagram of an X-ray tube with a composite target of a preferred embodiment of the invention.

FIG. 5 is a schematic diagram of an X-ray tube with a composite target of a preferred embodiment of the invention. Here, the composite target is used in the transmission type X-ray tube as an example to illustrate. However, the composite target is not limited to be used in the transmission type X-ray tube, it can be used in the reflection type X-ray tube, or any other type of X-ray tube.

Referring to FIG. 5, an X-ray tube includes a casing 310, an anode 320, a cathode 330, and a power source 340. The anode 320 is disposed at the casing 310. A composite target 350 is disposed on the anode 320. The composite target 350 is interacted with an electron 360 to generate an X-ray 370, and an energy of the electron 360 can be changed by controlling a tube voltage at least.

The composite target 350 includes a target body 352 and an interposing layer 354. The interposing layer 354 is connected with the target body 352. The interposing layer 354 may move a highest peak of an energy spectrum of the X-ray 370 toward a high energy direction. A low energy photon of the X-ray 370 is filtered by the interposing layer 354, and the low energy photon of the X-ray can be increased by increasing a thickness of the interposing layer 354. Also, as the tube voltage is enhanced, an amount of a high energy photon of the X-ray 370 generated is increased.

The cathode 330 is disposed in the casing 310 to provide the electron 360. The power source 340 is connected between the cathode 330 and the anode 320 to provide such as the tube voltage and tube current, so as to adjust the energy of the electron 360.

Referring to FIG. 5, the X-ray tube 300 may further include an electron track moving device 380 to control the position where the electron 360 enters the composite target 350.

Figure 6A:
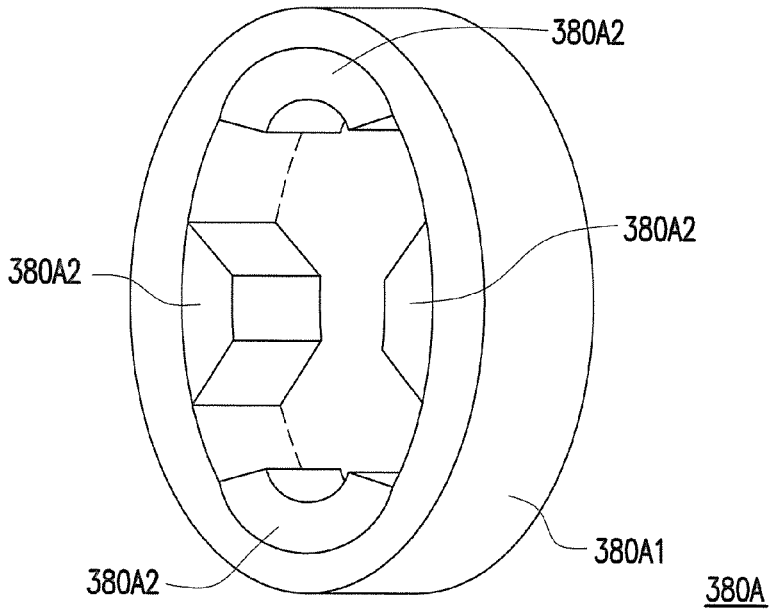
FIG. 6A to FIG. 6B are schematic diagrams of two types of electron track moving devices of embodiments of the invention.
Figure 6B:
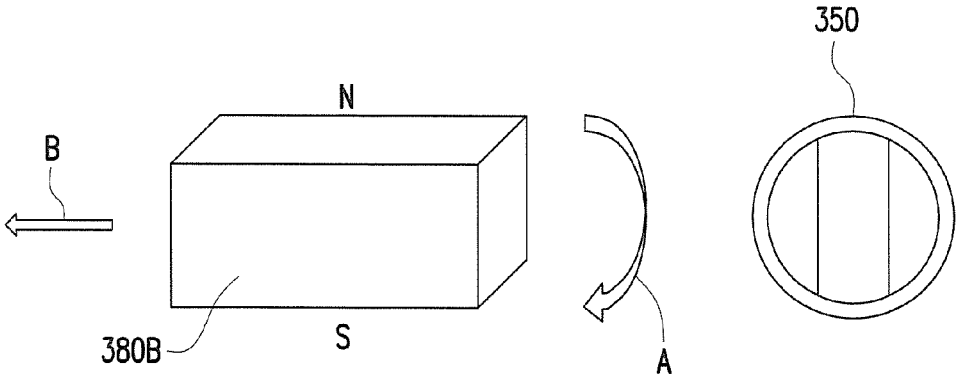

FIG. 6A to FIG. 6B are schematic diagrams of two types of electron track moving devices of embodiments of the invention. Referring to FIG. 6A, in an embodiment, an electron track moving device 380A may include a main body 380A1, and at least four electromagnets 380A2 correspondingly disposed on the main body 380A1.

Specifically, as shown in FIG. 5, the electron track moving device 380A of FIG. 6A may be disposed inside the X-ray tube 300. In an embodiment not shown, the electron track moving device 380A may also be disposed outside the X-ray tube 300. By adjusting the size and direction of magnetic force of the electromagnet 380A2, the electron 360 can be moved to any position on the composite target 350.

Referring to FIG. 6B, in another embodiment, the electron track moving device 380 may also be a magnet 380B. By rotating the magnet 380B (the arrow A as shown in FIG. 6B), the magnet performs a uniaxial movement (the arrow B as shown in FIG. 6B). Thereby, the electron 360 performs a uniaxial movement, so as to adjust the position where the electron 360 enters the composite target 350. As shown in FIG. 6B, the magnet 380B may be disposed outside the X-ray tube 300 to control the traveling track of the electron 360.

For the material of the target body 352, in an embodiment, the material of the target body 352 may be selected from the group consisting of scandium, titanium, vanadium, chromium, manganese, iron, cobalt, nickel, copper, zinc, germanium, yttrium, niobium, molybdenum, ruthenium, rhodium, palladium, silver, tin, barium, lanthanum, cerium, neodymium, gadolinium, terbium, dysprosium, holmium, erbium, thulium, ytterbium, lutetium, hafnium, tantalum, tungsten, rhenium, iridium, platinum, gold, thorium, uranium, and a combination thereof.

Additionally, the material of the interposing layer 354 may be selected from the group consisting of copper, silver, gold, indium, nickel, tin, aluminum, diamond, bismuth, antimony, tungsten, molybdenum, tantalum, zinc, cobalt, and a combination thereof.

Figure 7:
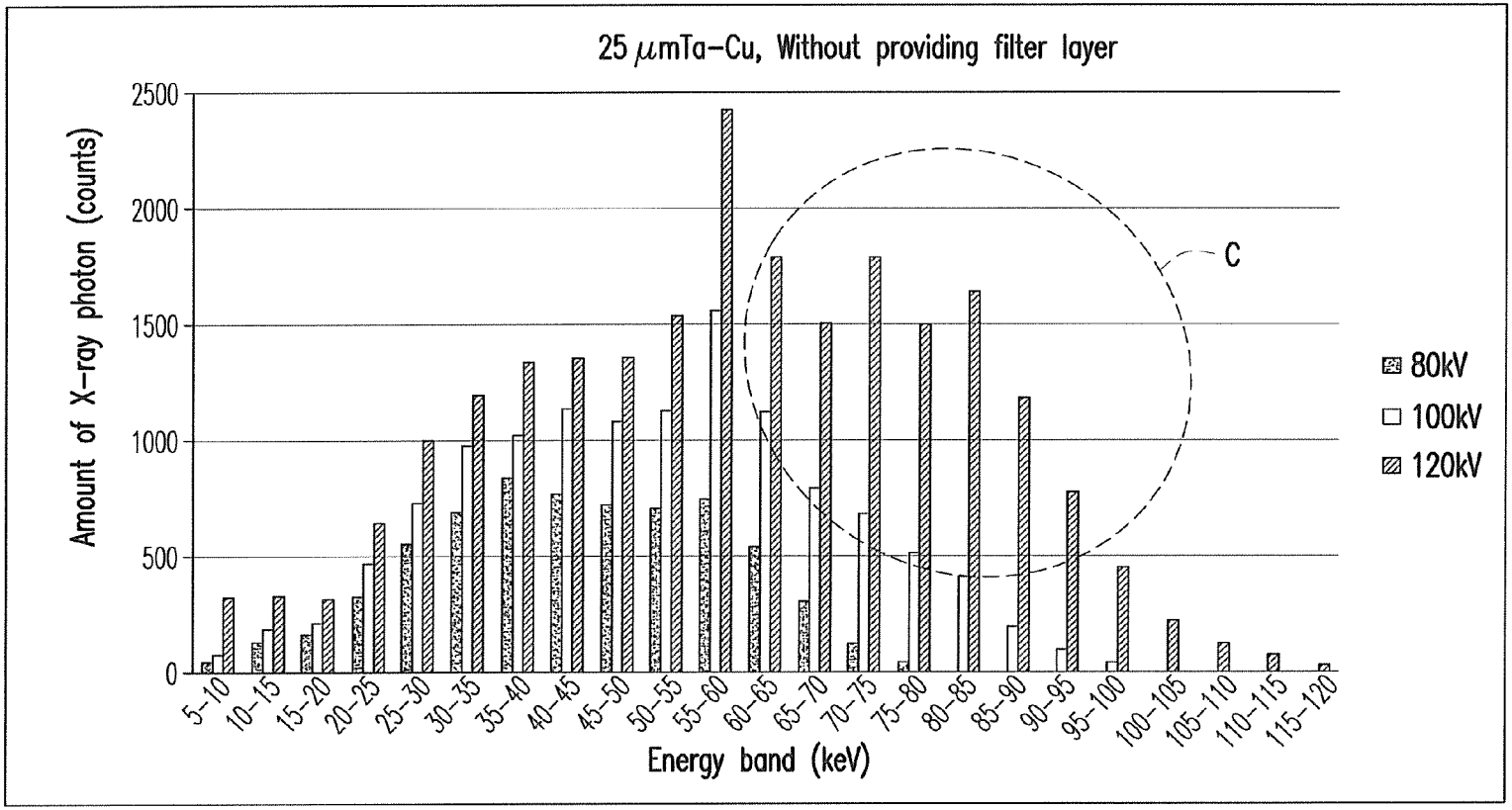
FIG. 7 illustrates an output spectrum of a transmission type X-ray tube of an embodiment of the invention.
Figure 8:
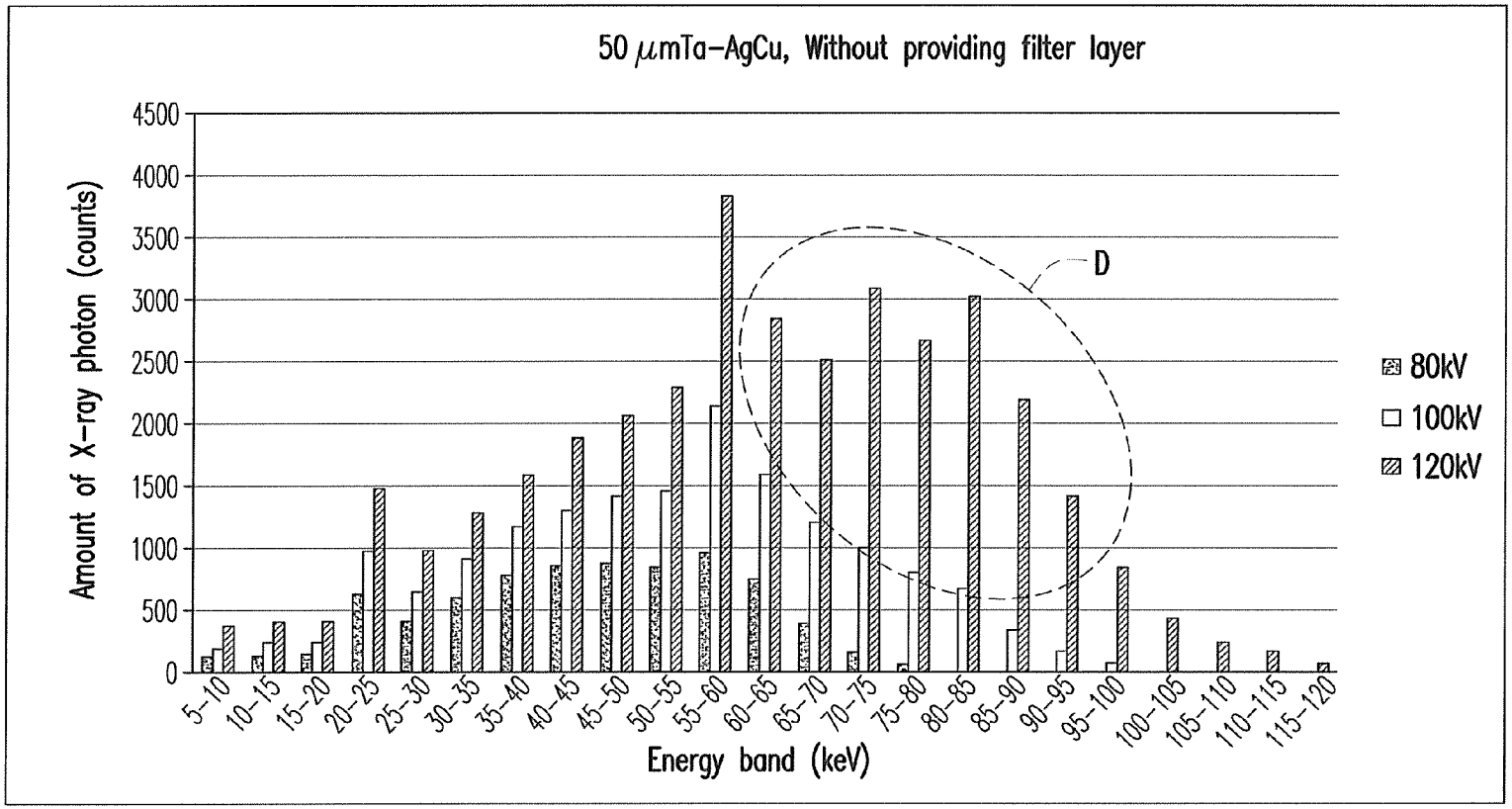
FIG. 8 illustrates an output spectrum of a transmission type X-ray tube of another embodiment of the invention.
Figure 9A:
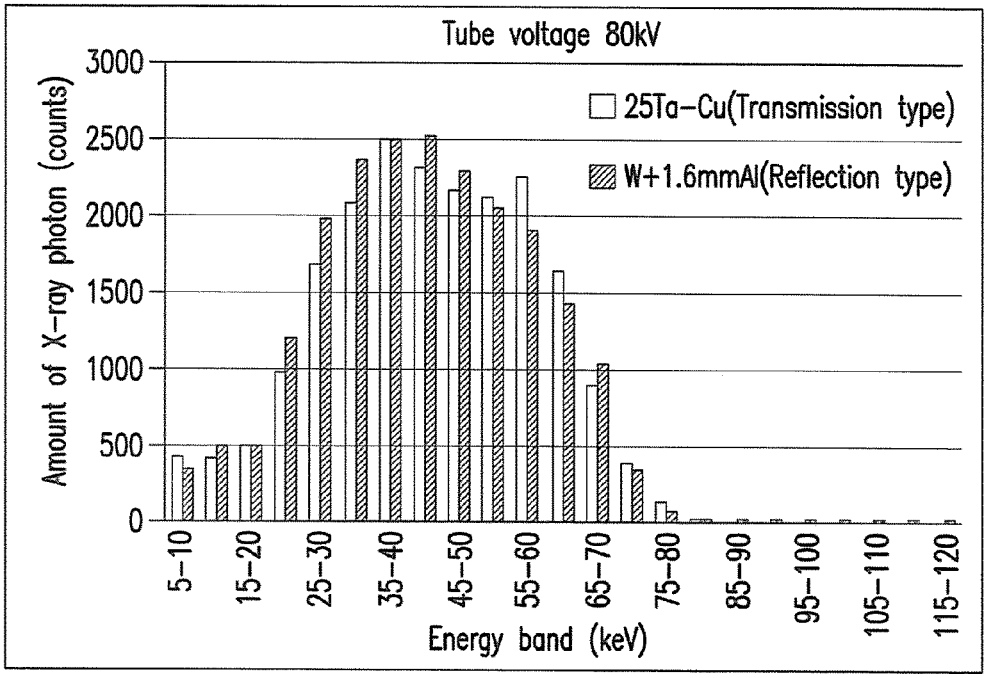
FIG. 9A to FIG. 9E are diagrams illustrating the comparison between an output spectrum of a transmission type X-ray tube of an embodiment of the invention and an output spectrum of a conventional reflection type X-ray tube.
Figure 9B:
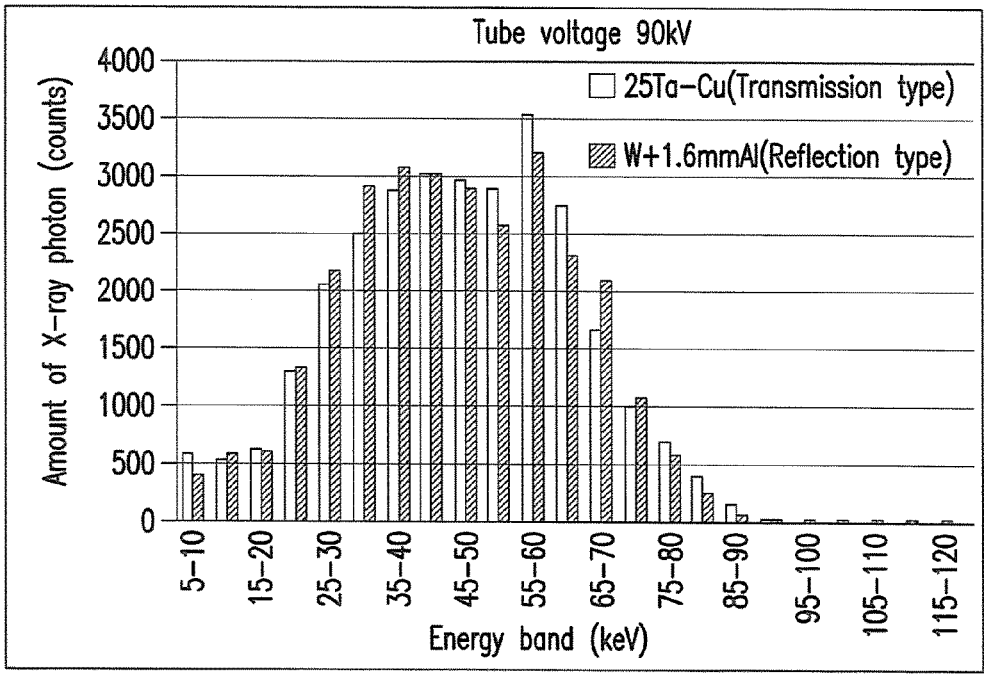
Figure 9C:
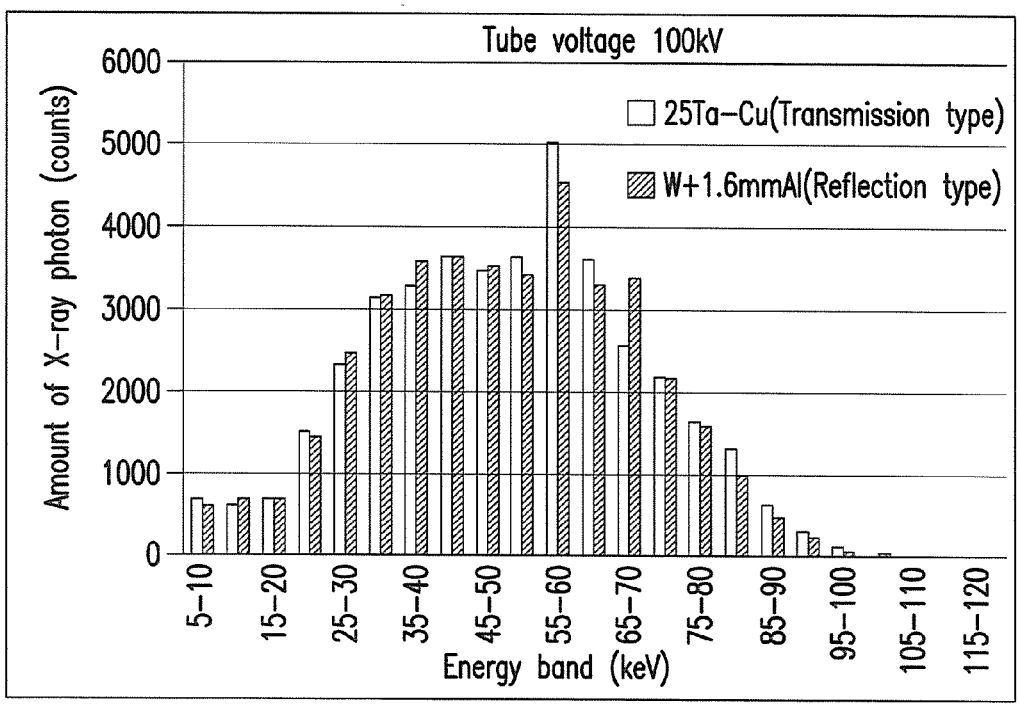
Figure 9D:
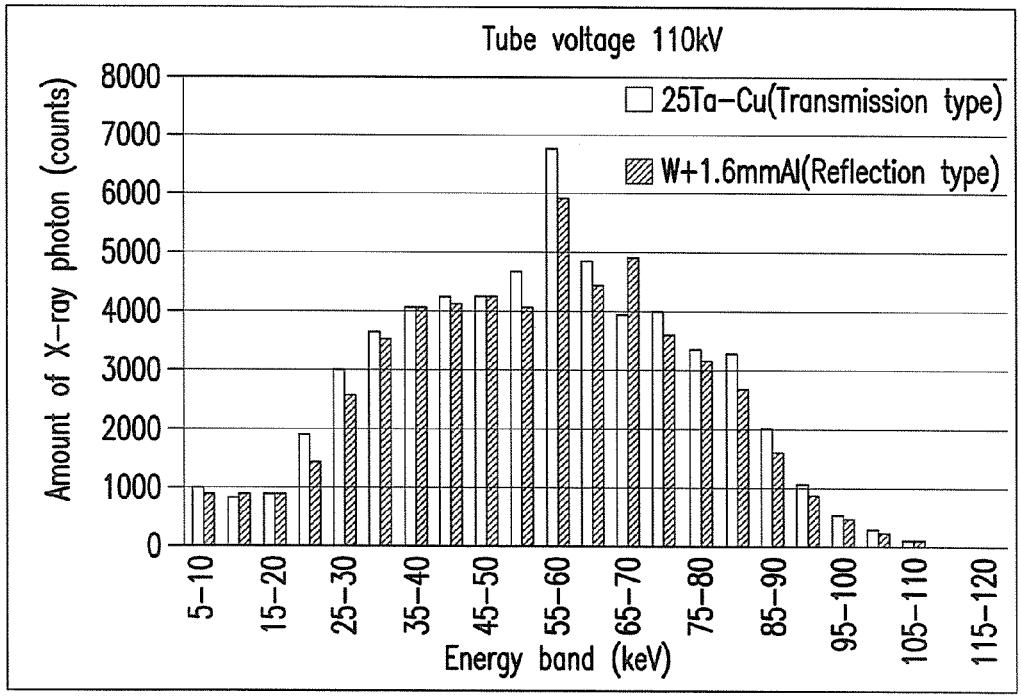
Figure 9E:
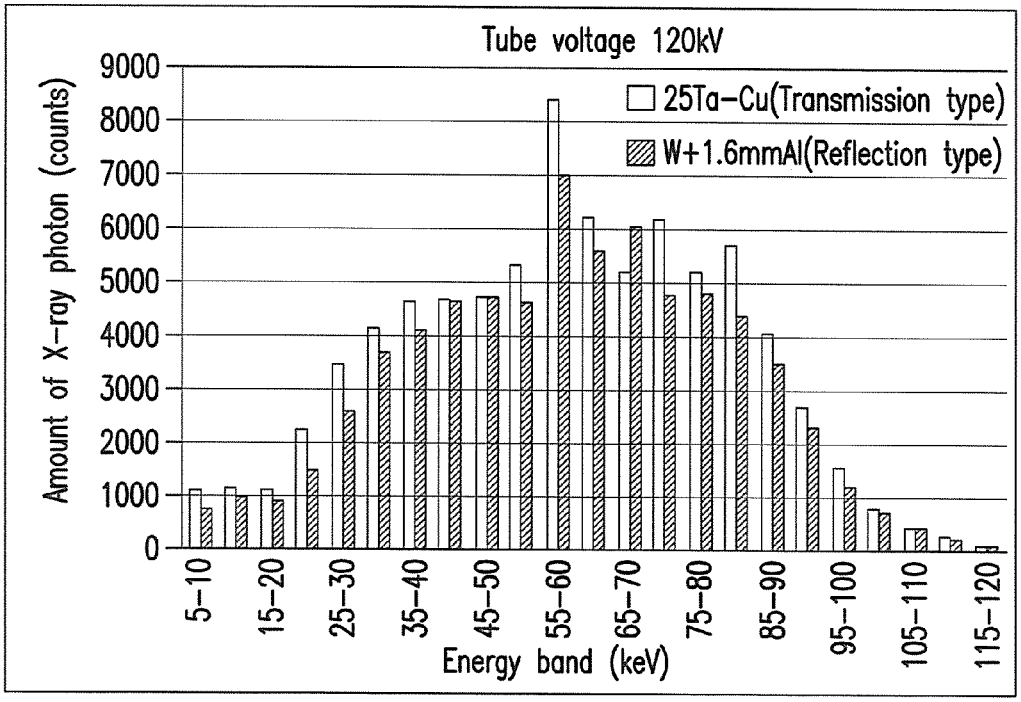
Figure 10A:
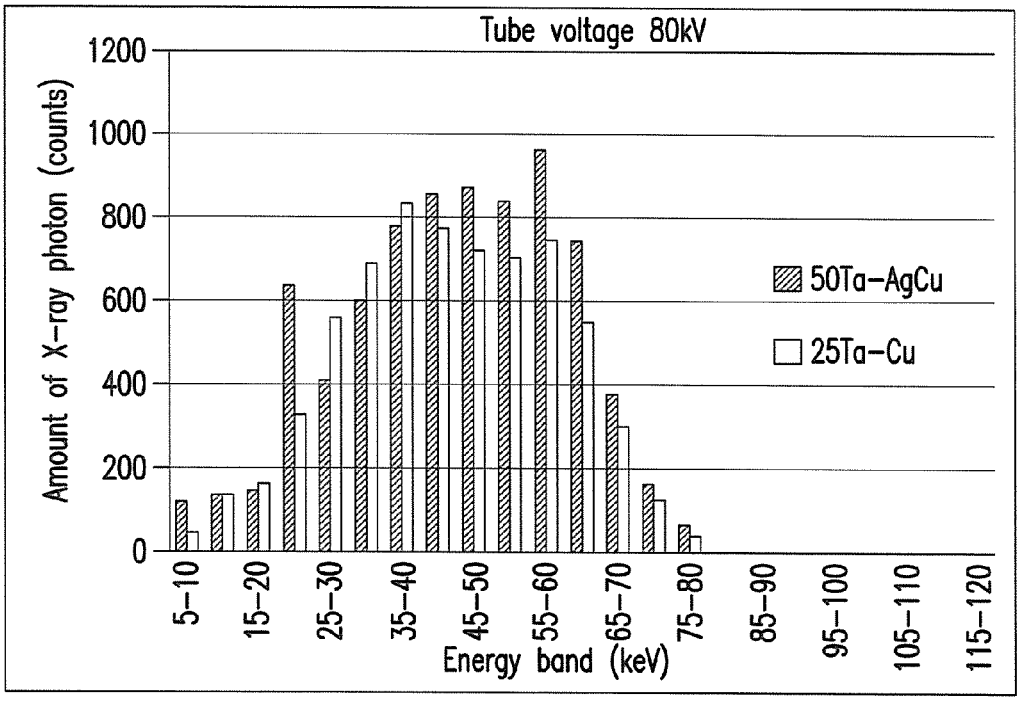
FIG. 10A to FIG. 10E are diagrams illustrating the comparison of an output spectrum of a transmission type X-ray tube having different interposing layers.
Figure 10B:
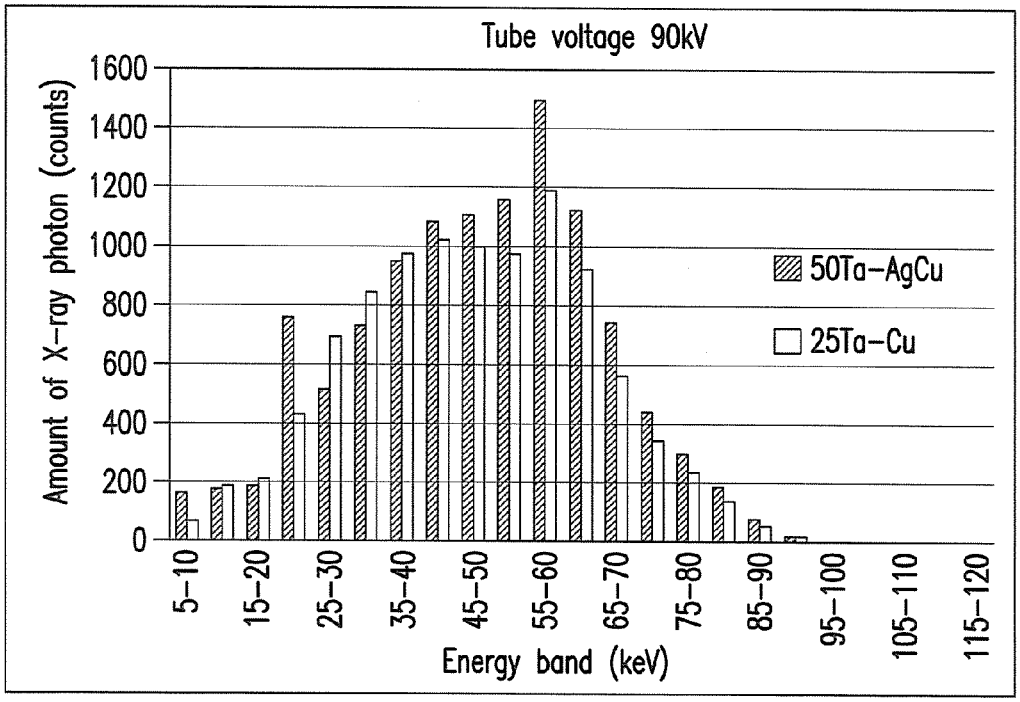
Figure 10C:
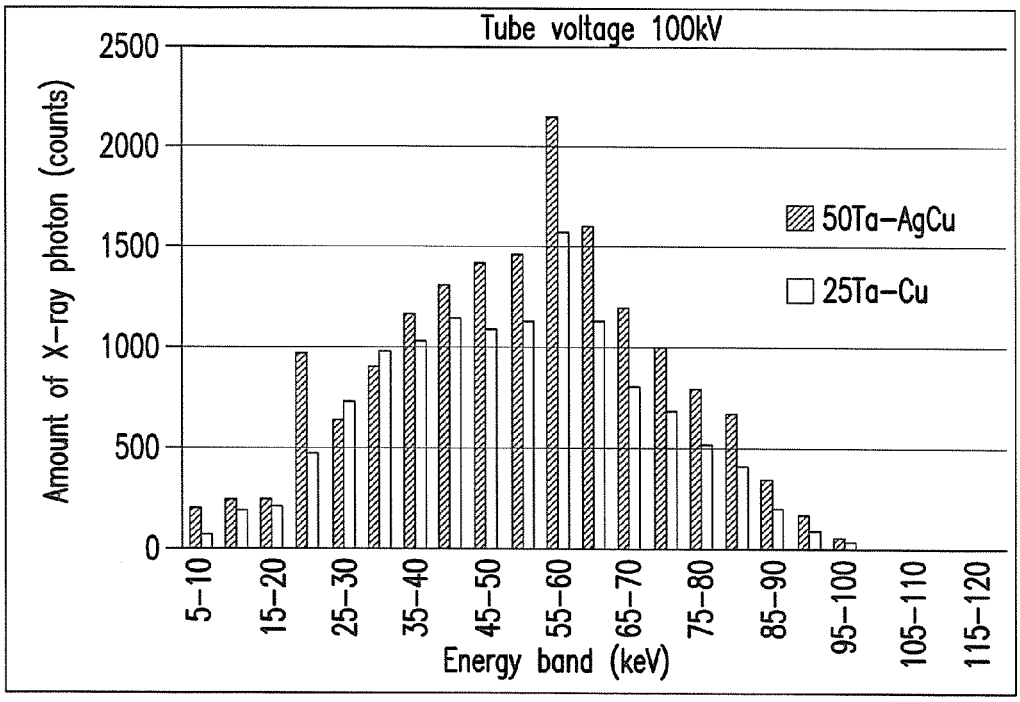
Figure 10D:
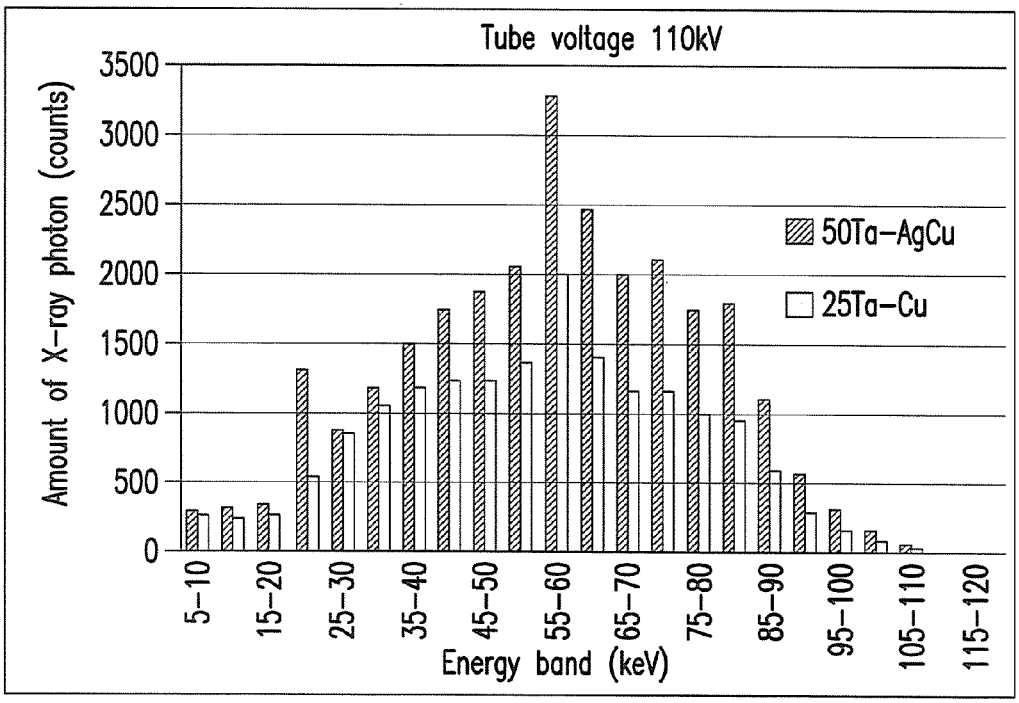
Figure 10E:
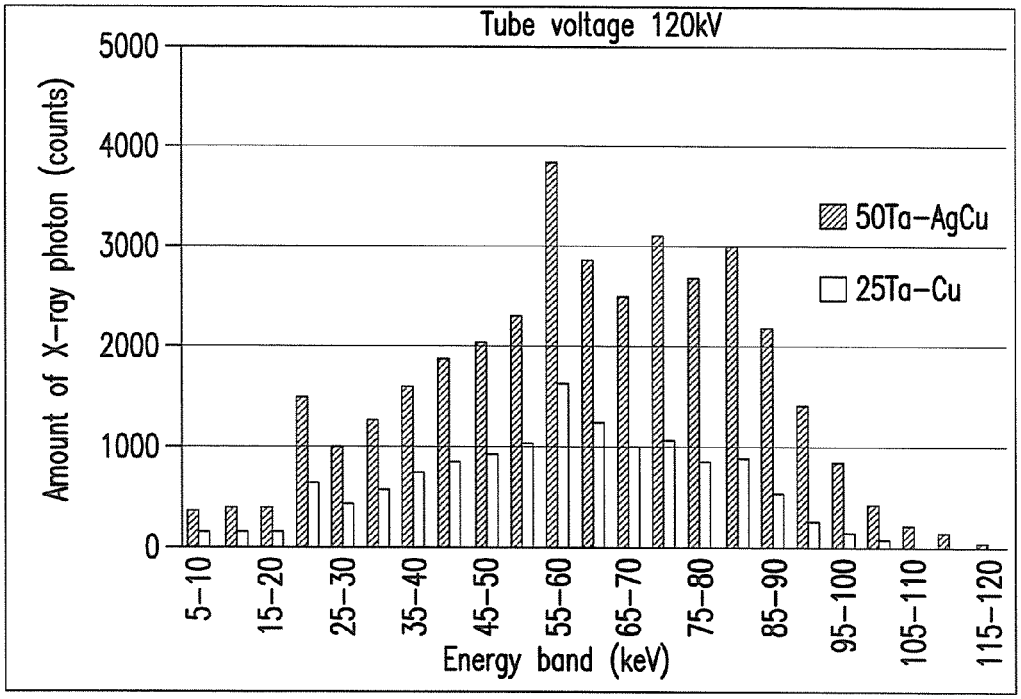

Hereinafter, the effect of the X-ray energy spectrum distribution adjusted by the composite target is illustrated by FIG. 7 and FIG. 8. FIG. 7 illustrates an output spectrum of a transmission type X-ray tube of an embodiment of the invention. The composite target 350, having a thickness of 25 μm, without providing a filter layer, the target body 352 using tantalum, and the interposing layer 354 using copper is used. In FIG. 7, the horizontal axis represents the energy hand of the X-ray photon, and the vertical axis represents the amount of the X-ray photon. FIG. 7 also illustrates the distribution of the X-ray photon when the tube voltage is different (80 kV, 100 kV, and 120 kV).

Referring to FIG. 7, as the tube voltage is enhanced (80 kV→100 kV→120 kV, as shown in FIG. 7), the amount of the high energy photon of the X-ray (equal to or more than 60 KeV, the circle C part as shown in FIG. 7) of the X-ray tube 300 using the composite target 350 is significantly increased.

Figure 1:
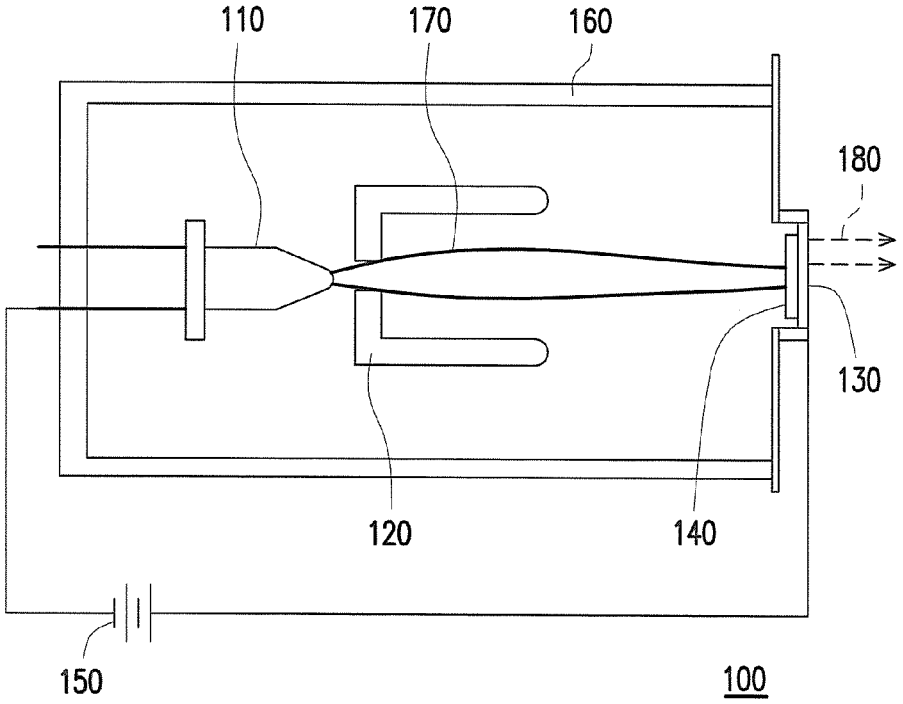
FIG. 1 is a schematic diagram of a conventional transmission type X-ray tube.
Figure 2:
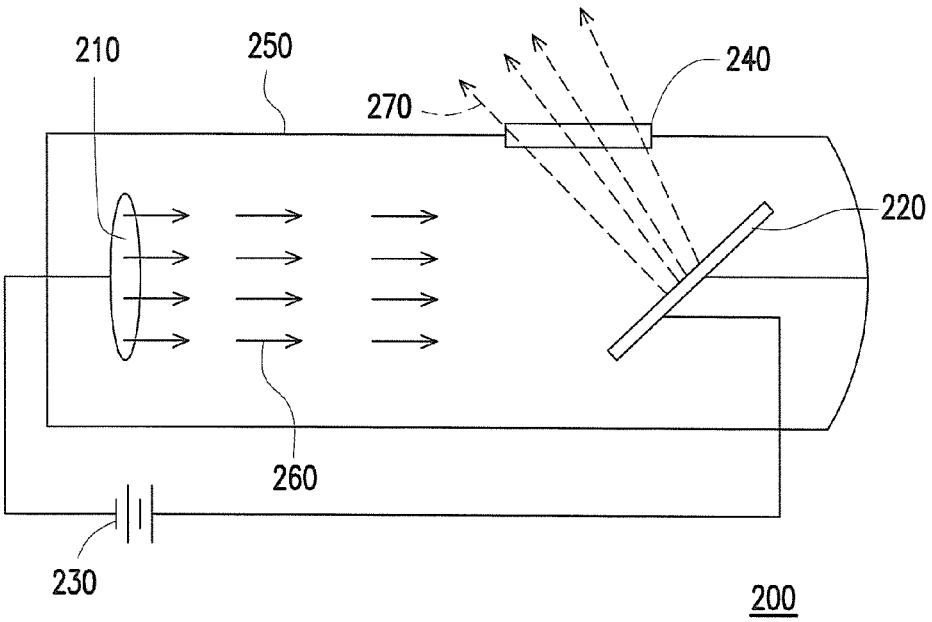
FIG. 2 is a schematic diagram of a conventional reflection type X-ray tube.
Figure 3:
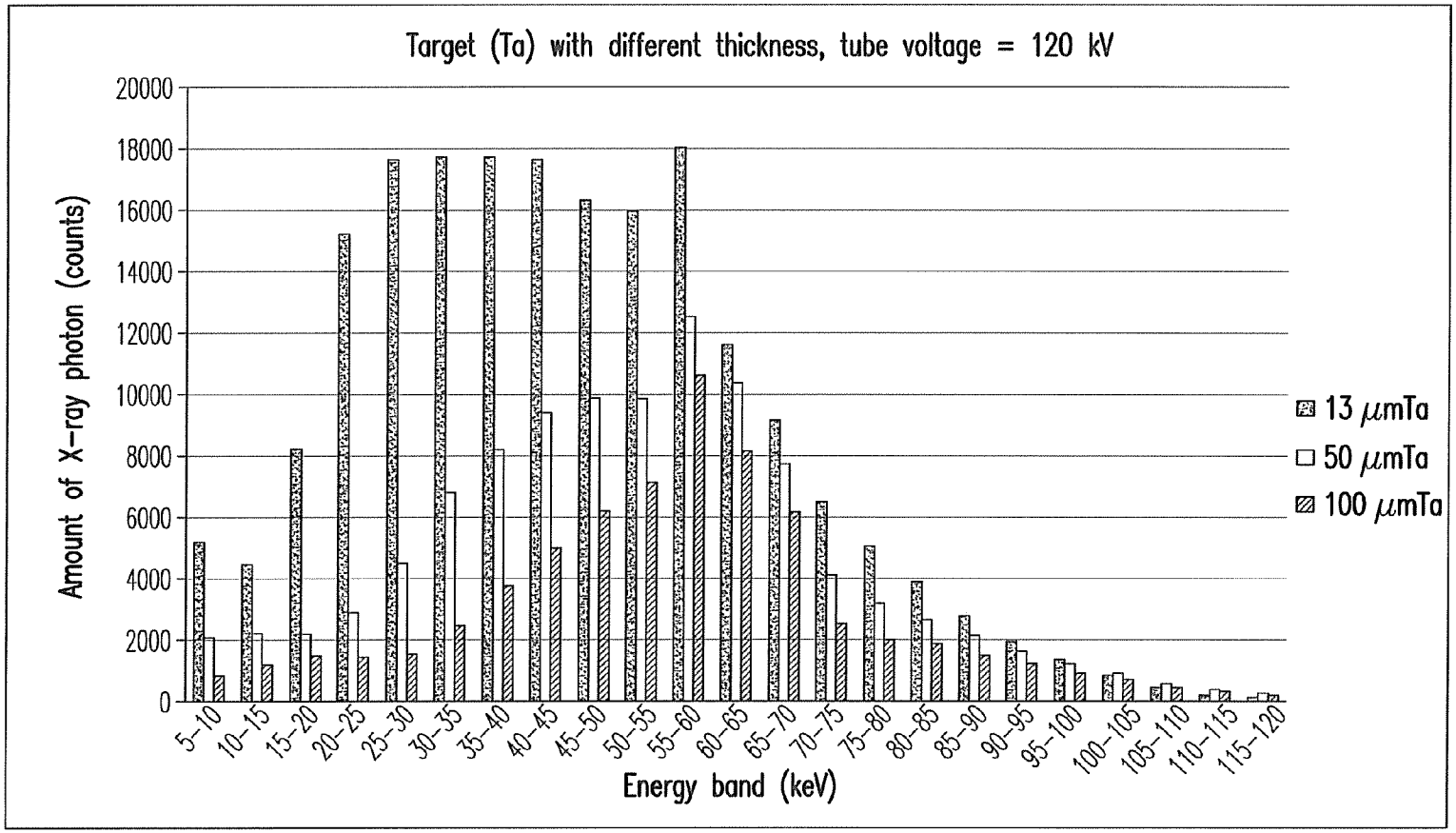
FIG. 3 illustrates an output spectrum of a transmission type X-ray tube.
Figure 4:
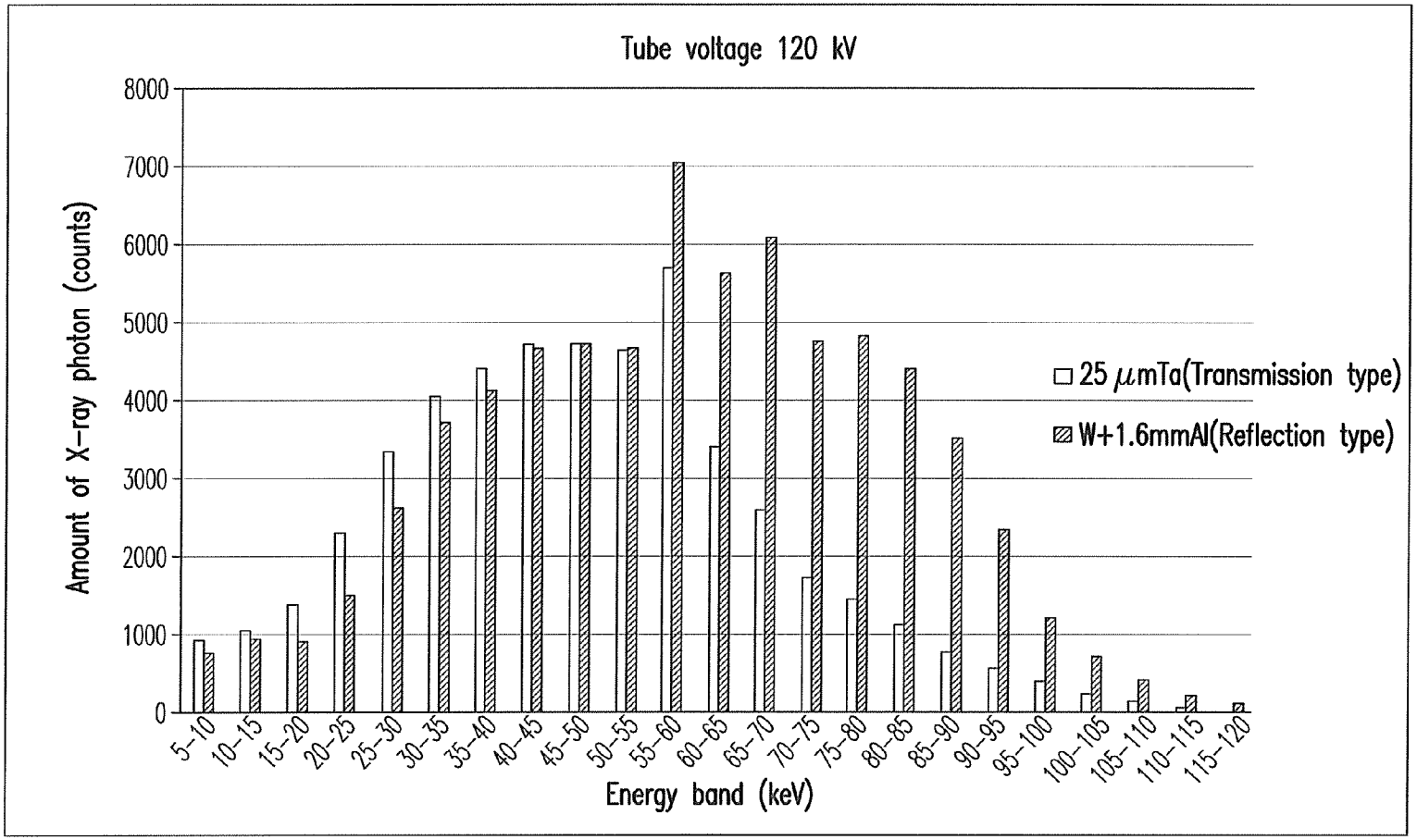
FIG. 4 is a diagram illustrating the comparison between an output spectrum of a transmission type X-ray tube and an output spectrum of a reflection type X-ray tube.

From the comparison between the conventional FIG. 3A (without the interposing layer) and FIG. 7 of the invention (with the interposing layer 354, copper), it can be seen that, the interposing layer 354 changes the X-ray energy spectrum distribution as shown in FIG. 7. That is, the amount of the overall photon of the X-ray 370 (including the low energy photon of the X-ray and the high energy photon of the X-ray) occupied by the high energy photon of the X-ray is significantly increased, especially helpful to enhance the penetration for the object.

FIG. 8 illustrates an output spectrum of a transmission type X-ray tube of another embodiment of the invention. Another composite target 350, having a thickness of 25 μm, without providing a filter layer, the target body 352 using tantalum, and the interposing layer 354 using the composite material of copper and silver is used. In FIG. 8, the horizontal axis represents the energy band of the X-ray photon, and the vertical axis represents the amount of the X-ray photon. FIG. 8 also illustrates the distribution of the X-ray photon when the tube voltage is different (80 kV, 100 kV, and 120 kV).

Similarly, from the comparison between the conventional FIG. 3B (without the interposing layer) and FIG. 8 of the invention (with the interposing layer 354, copper and silver), it can be seen that, the amount of the overall photon of the X-ray 370 (including the low energy photon of the X-ray and the high energy photon of the X-ray) occupied by the high energy photon of the X-ray (equal to or more than 60 KeV, the circle D part as shown in FIG. 8) is significantly increased, especially helpful to enhance the penetration for the object.

According to the above, the X-ray energy spectrum distribution of the transmission type X-ray tube 300 using the composite target (with the interposing layer 354) can be adjusted to dramatically increase the high energy photon of the X-ray. Therefore, the issue of the conventional transmission type X-ray tube 100 using the single target can be avoided.

FIG. 9A to FIG. 9E are diagrams illustrating the comparison between an output spectrum of a transmission type X-ray tube of an embodiment of the invention and an output spectrum of a conventional reflection type X-ray tube. The transmission type X-ray tube 300 of an embodiment of the invention uses the composite target 350, having a thickness of 25 μm, the target body 352 using tantalum, the interposing layer 354 using copper, and without providing a filter layer; and the conventional reflection type X-ray tube 200 uses tungsten (W) as the target, and with 1.6 mm of aluminum as a filter material. FIG. 9A to FIG. 9E respectively represents an output spectrum when the tube voltage is 80 kV, 90 kV, 100 kV, 110 kV, and 120 kV.

It can be learned from FIG. 9A to FIG. 9E that, since the interposing layer 354 is adopted by the transmission type X-ray tube 300 using the composite target 350 of the invention, the high energy photon of the X-ray can be dramatically increased, thereby obtaining the X-ray energy spectrum distribution which is similar to that of the conventional reflection type X-ray tube 200. Particularly, compared to the conventional reflection type X-ray tube 200, the interposing layer 354 of the invention may further filter the low energy photon of the X-ray which is harmful to the human body.

FIG. 10A to FIG. 10E are diagrams illustrating the comparison of an output spectrum of a transmission type X-ray tube having different interposing layers. The composite target used by one transmission type X-ray tube has a thickness of 25 μm, the target body 352 using tantalum, the interposing layer 354 using copper, and without providing a filter layer.

The composite target used by another one transmission type X-ray tube has a thickness of 25 μm, the target body 352 using tantalum, the interposing layer 354 using the composite material of copper and silver. FIG. 10A to FIG. 10E respectively represents an output spectrum when the tube voltage is 80 kV, 90 kV, 100 kV, 110 kV, and 120 kV.

Referring to FIG. 10A to FIG. 10E, it can be seen that, the amount of the X-ray photon generated from the interposing layer 354 using the composite material of copper and silver is more than the amount of the X-ray photon generated from the interposing layer 354 using copper. Also, as the tube voltage is enhanced, the above trend is more obvious. It can be seen that, by changing the material composition of the interposing layer 354, the production efficiency of the X-ray photon can be adjusted.

FIG. 11 to FIG. 15 are schematic cross-sectional diagrams of composite targets of several embodiments of the invention. The X-ray with a designated energy spectrum distribution chosen by the setting method of the film layer of the composite target is illustrated by FIG. 11 to FIG. 15.

Figure 11:
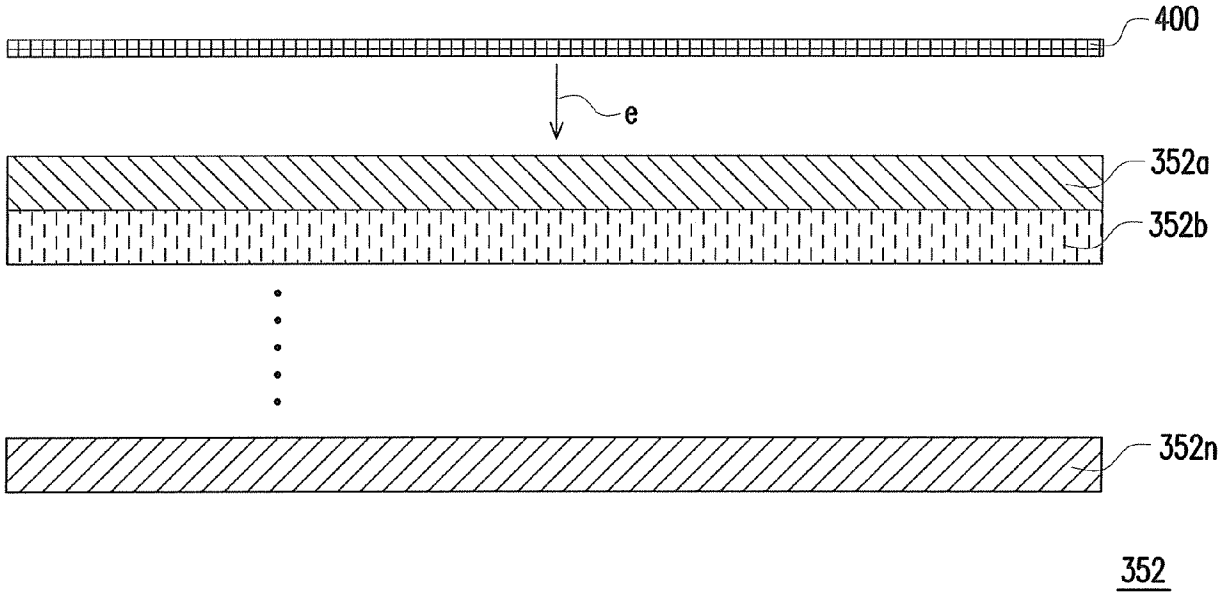
FIG. 11 to FIG. 15 are schematic cross-sectional diagrams of composite targets of several embodiments of the invention.

Referring to FIG. 11, the target body 352 at least includes a first film layer 352*a*, and a second film layer 352*b* (a number n of film layers are shown in FIG. 11). The second film layer 352*b* is disposed at one side of the first film layer 352*a*. The electron e can be interacted with the first film layer 352*a* and the second film layer 352*b*, so as to choose the X-ray with a designated energy spectrum distribution.

Specifically, as shown in FIG. 11, the electron e can pass the first film layer 352*a* and the second film layer 352*b* to perform the mechanism for generating the X-ray, so as to generate the X-ray with a designated energy spectrum distribution.

Actually, the target body 352 may include a number n of film layers, such as the first film layer 352*a*, the second film layer 352*b*, . . . , and the nth film layer 352*n*. In an embodiment of FIG. 11, the electron e can pass the film layer composed of any combination of the first film layer 352*a*, the second film layer 352*b*, . . . , and the nth film layer 352*n*, so as to obtain the required X-ray energy spectrum distribution.

Additionally, when setting the first film layer 352*a*, the second film layer 352*b*, . . . , and the nth film layer 352*n*, if the electron penetration depth is less than the thickness of the first film layer 352*a*, the first film layer 352*a* is a main film layer (as the target body), and other film layers 352*b*, . . . , 352*n* are as the interposing layers. If the electron penetration depth is less than the thickness of the first film layer 352*a* plus the second film layer 352*b*, both the first film layer 352*a* and the second film layer 352*b* are the main film layers (as the target body), and other film layers . . . , 352*n* are as the interposing layers. The following several basic settings are usually performed.

The first setting: more high energy photon part is left. The atomic number of the film layer material of the first film layer 352*a*, the second film layer 352*b*, . . . , and the nth film layer 352*n* is that, the first film layer 352*a*> the second film layer 352*b*> . . . the nth film layer 352*n* in order, and the thickness of the main film layer (i.e. target body) is more than the total thickness of other film layers (i.e. interposing layer).

The second setting: the low energy photon and the high energy photon are filtered. The thickness of the main film layer (i.e. target body) is less than the total thickness of other film layers (i.e. interposing layer), and the atomic number of the nth film layer 352*n* is more than the atomic number of the main film layer.

In industrial applications, the preferred setting of the thickness of the main film layer (i.e. target body) is 1/7 to 1/3 times a maximum electron penetration depth of the material.

In medical diagnosis, the preferred setting of the thickness of the main film layer (i.e. target body) is 3 to 10 times a maximum electron penetration depth of the material, which is the preferred thickness setting.

In medical treatment, the thickness of the main film layer (i.e. target body) for enhanced generation of characteristic radiation energy spectrum is 10 to 30 times a maximum electron penetration depth of the material, which is the preferred thickness setting.

The maximum depth D of the high energy electron penetrating the target changes with different target, and formula is as follows:

$$D(\mu m) = \frac{2.76 \times 10^{-2} A E^{1.67}}{\rho Z^{0.89}}$$

wherein, ρ=target density; Z=atomic number; A=atomic mass; E=incident electron voltage.

Figure 12:
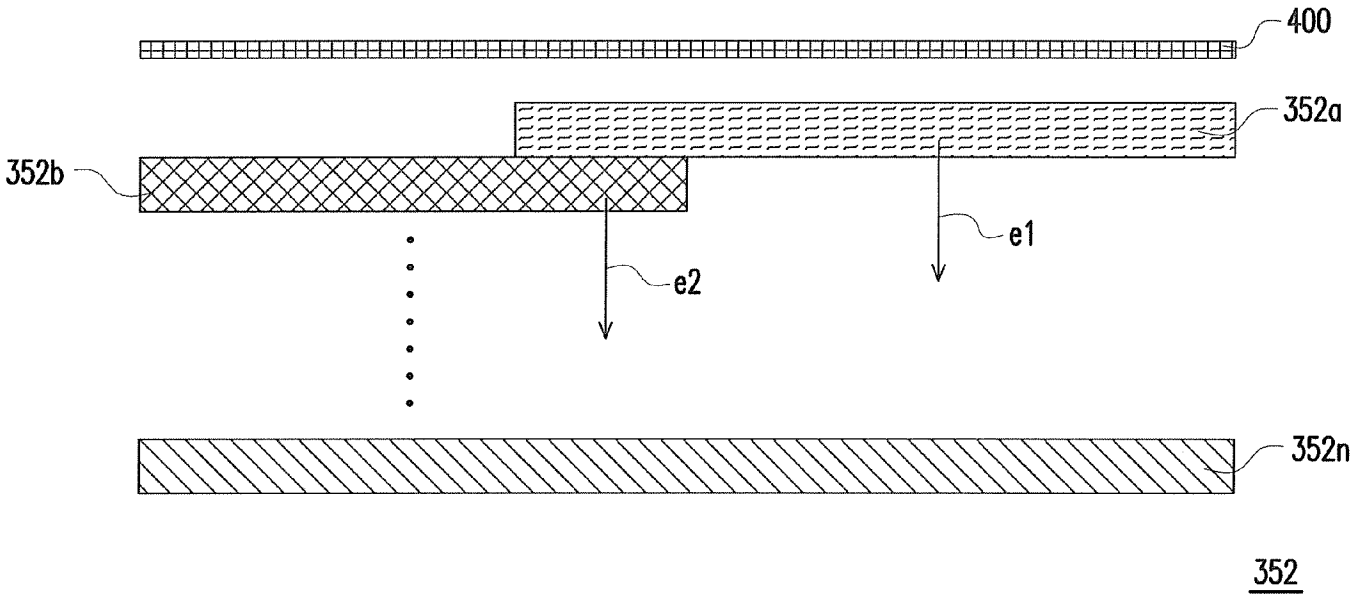

Referring to FIG. 12, the target body 352 at least includes a first film layer 352*a*, and a second film layer 352*b*. The second film layer 352*b* is disposed at one side of the first film layer 352*a*. It can be noted that, the second film layer 352*b* and the first film layer 352*a* are staggered stacked, and electrons e1 and e2 can be interacted with the first film layer 352*a*, and a stacking location of the first film layer 352*a* and the second film layer 352*b* respectively, so as to choose the X-ray with a designated energy spectrum distribution.

Specifically, as shown in FIG. 12, there is the first film layer 352*a* at part of the position, and there is a stacked structure of the first film layer 352*a* and the second film layer 352*b* at another part of the position. When the electron e1 enters the first film layer 352*a*, the X-ray with the first setting energy spectrum distribution can be generated; and when the electron e2 enters the stacked structure of the first film layer 352*a* and the second film layer 352*b*, the X-ray with the second setting energy spectrum distribution can be generated.

It can be learned that, by changing the stacking ways of the film layer of the target body 352 and the position where the electrons e1 and e2 enter the target body 352, the X-ray with a variety of designated energy spectrum distributions can be provided and chosen according to the required conditions.

Actually, as shown in FIG. 12, the target body 352 may include a number n of film layers, such as the first film layer 352*a*, the second film layer 352*b*, . . . , and the nth film layer 352*n*. That is, the first film layer 352*a*, the second film layer 352*b*, . . . , and the nth film layer 352*n* can be staggered stacked to obtain various film layer stacked structures. When the electron e enters different film layer stacked structure, the X-ray with a variety of designated energy spectrum distributions can be provided.

Figure 13:
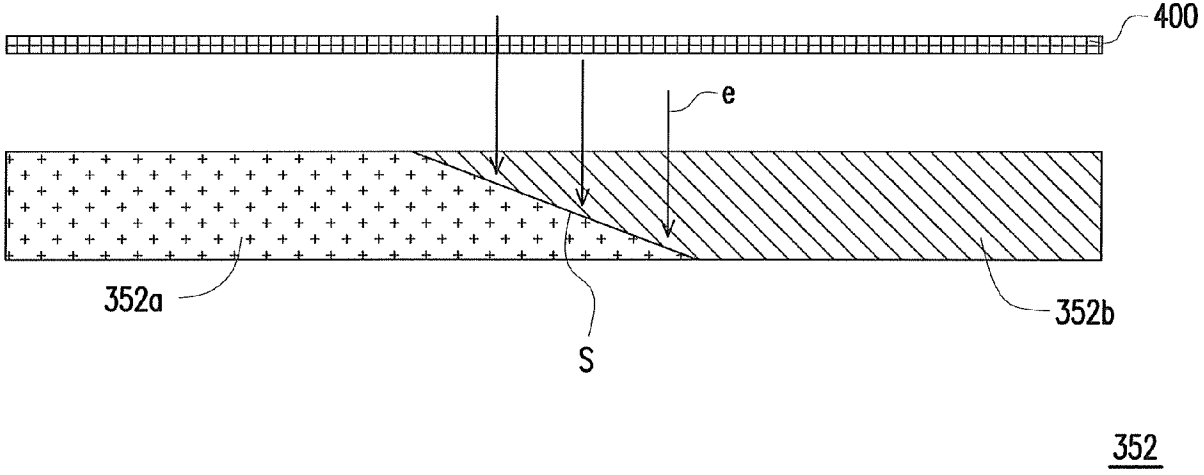

Referring to FIG. 13, the target body 352 at least includes the first film layer 352*a*, and the second film layer 352*b*. The first film layer 352*a* and the second film layer 352*b* have a tilt interface S therebetween. The position of the electron e relative to the tilt interface S can be adjusted, such that the electron e can be interacted with the first film layer 352*a* and the second film layer 352*b*, so as to choose the X-ray with a designated energy spectrum distribution.

As shown in FIG. 13, the position where the electron c enters the target body 352 can be moved from the left side to the right side of the target body 352. When the electron e only enters the first film layer 352*a* disposed at the left side, the X-ray completely generated from the first film layer 352*a* can be obtained; and when the electron e only enters the second film layer 352*b* disposed at the right side, the X-ray completely generated from the second film layer 352*b* can be obtained.

Particularly, when the electron e enters the position of the tilt interface S, the X-ray co-generated from the first film layer 352*a* and the second film layer 352*b* can be obtained. Additionally, by moving the position of the electron e relative to the tilt interface S, the X-ray energy spectrum distribution generated from the first film layer 352*a* and the second film layer 352*b* composed in different proportions can be obtained.

Figure 14:
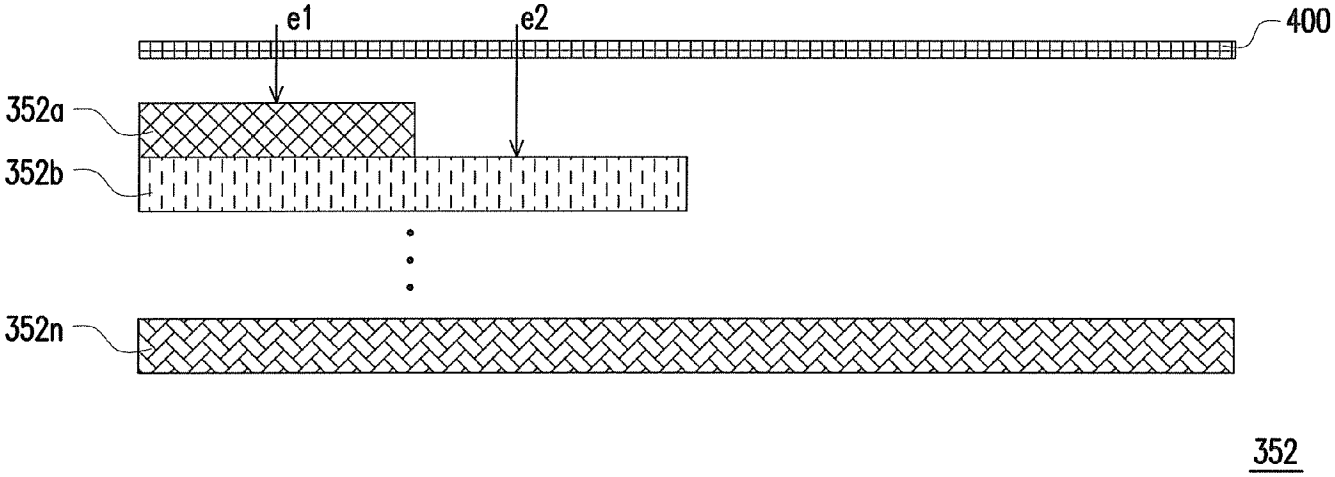

Referring to FIG. 14, the target body 352 at least includes the first film layer 352*a*, and the second film layer 352*b*. The second film layer 352*b* is disposed at one side of the first film layer 352*a*. The first film layer 352*a* and the second film layer 352*b* are stepped stacked. The electrons e1 and e2 can be interacted with the stacking location of the first film layer 352*a* and the second film layer 352*b*, and the second film layer 352*b* respectively, so as to choose the X-ray with a designated energy spectrum distribution.

Specifically, as shown in FIG. 14, the thickness of the target body 352 is different from each other from the left side to the right side of the target body 352. When two film layers are adopted, that is, the first film layer 352*a* and the second film layer 352*b* are stepped stacked, the electron e1 enters the stacking location of the first film layer 352*a* and the second film layer 352*b* of the target body 352, and the electron e2 enters the second film layer 352*b* only. In other words, by adjusting the position where the electrons e1 and e2 enter the target body 352, the X-ray with different energy spectrum distribution can be generated from the target body 352 with different thickness respectively.

Actually, as shown in FIG. 14, the target body 352 may include a number n of film layers, such as the first film layer 352*a*, the second film layer 352*b*, . . . , and the nth film layer 352*n*. That is, by the stepped stacked method to stack the first film layer 352*a*, the second film layer 352*b*, . . . , and the nth film layer 352*n*, the film layer stacked structure with various thicknesses can be obtained. When the electron e enters the film layer stacked structure with different thickness, the X-ray with a variety of designated energy spectrum distributions can be provided.

Figure 15:
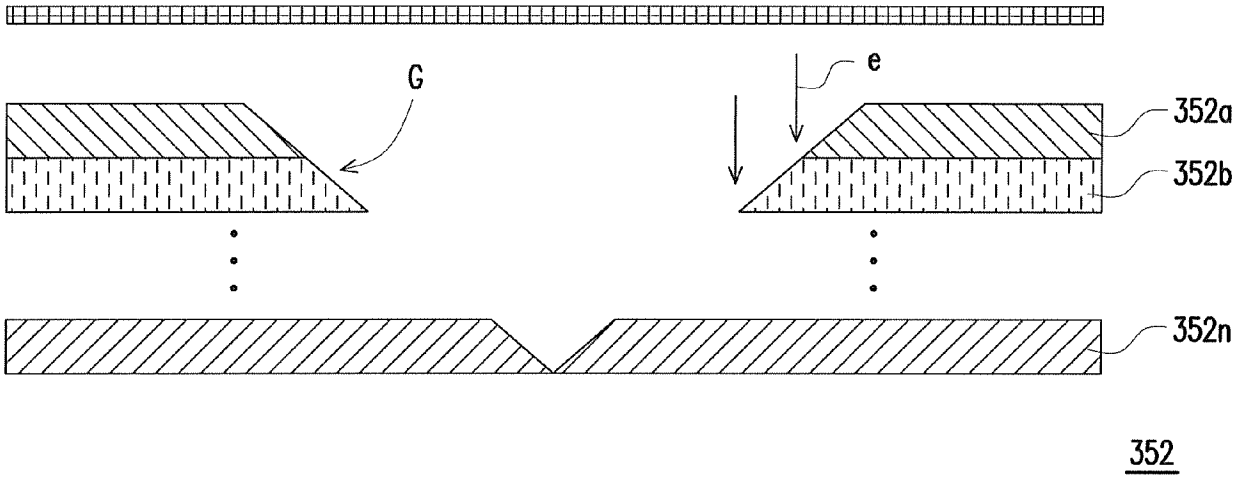

Referring to FIG. 15, the target body 352 at least includes the first film layer 352*a*, and the second film layer 352*b*. The second film layer 352*b* is disposed at one side of the first film layer 352*a*. In the first film layer 352*a* and the second film layer 352*b*, a groove G with a designated shape is formed. The electron e can penetrate the groove G, and the electron e can be interacted with the stacking location of the first film layer 352*a* and the second film layer 352*b*, so as to choose the X-ray with a designated energy spectrum distribution.

Specifically, in the target body 352 as shown in FIG. 15, the groove G may be a conical groove which causes the target body 352 having different thickness and different stacked structure at different position. When the electron e enters the target body 352 at different thickness or different stacked structure, the X-ray with a variety of designated energy spectrum distributions can be provided.

Actually, as shown in FIG. 15, the target body 352 may include a number n of film layers, such as the first film layer 352*a*, the second film layer 352*b*, . . . , and the nth film layer 352*n*. After the first film layer 352*a*, the second film layer 352*b*, . . . , and the nth film layer 352*n* are stacked, an etching process may be performed to form the groove G. When the electron e enters the target body 352 at different position, the X-ray with a designated energy spectrum distribution corresponding to the film layer structure of the position can be provided.

By using the thickness gradient distribution, or stepped type distribution of the target body 352 of FIG. 11 to FIG. 15 coordinated with controlling the position where the electron e enters the target body 352, the X-ray with different energy spectrum distribution can be generated at the same tube voltage, so as to be conducive to adjust the image contrast ratio and adjust to the best image.

In other words, in a single X-ray tube 300 using the above composite target 350, the X-ray with various energy spectrum distributions can be generated by the single X-ray tube 300. Therefore, the single X-ray tube 300 can be used in a variety of technical fields. Also, the trouble of replacing the X-ray tube according to different conditions can be avoided in the prior art.

Referring to FIG. 5, and FIG. 11 to FIG. 15 at the same time, in the composite target 350, a protective layer 400 may also be further provided. The protective layer 400 is disposed at an upstream side of the composite target 350, and the protective layer 400 faces the electron 370. The critical energy of electron sputtering of the protective layer 400 is more than the critical energy of electron sputtering of the target body 352. Although FIG. 5 shows that the protective layer 400 and the composite target 350 are separately disposed, the protective layer 400 may be integrally disposed with the composite target 350. For example, the protective layer 400 is formed on a surface of the composite target 350.

By the protective layer 400, the situation of material loss of the composite target 350 caused by electron bombardment may be reduced, and the situations of volatilization generated from high temperature of the composite target 350 or sublimation phenomenon generated from the vacuum being too high in the tube can be avoided.

Figure 16C:
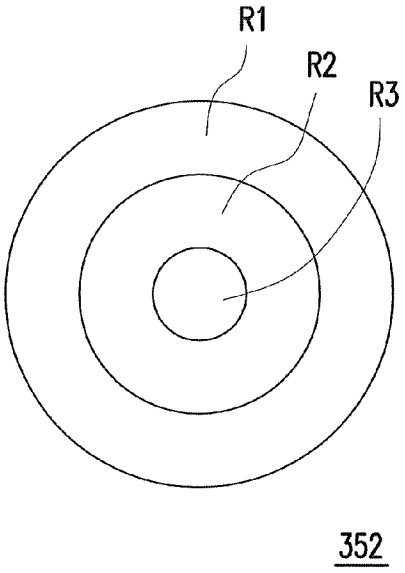
FIG. 16A to FIG. 16C are schematic top views of composite targets of several embodiments of the invention.
Figure 16B:
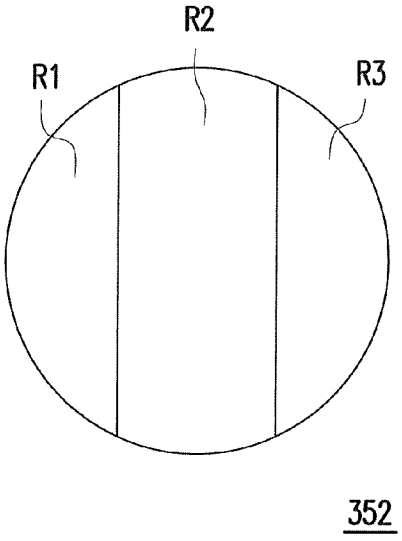
Figure 16A:
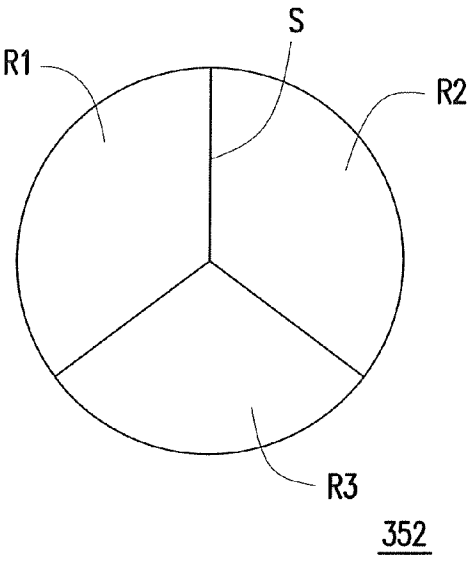

FIG. 16A to FIG. 16C are schematic top views of composite targets of several embodiments of the invention. Referring to FIG. 16A first, the target body 352 is divided into at least a first region R1 and a second region R2, and the first region R1 and the second region R2 have an interface therebetween. The electron e can be interacted with the first region R1 and the second region R2 respectively, so as to choose the X-ray with a designated energy spectrum distribution.

Actually, the target body 352 in FIG. 16A can be divided into the first region R1 to the third region R3, or can be divided into an infinite number of parts. Additionally, the position where the electron e hits the first region R1 to the third region R3 or the interface S of the target body 352 can be controlled, so as to choose the X-ray with a designated energy spectrum distribution.

FIG. 16B is another method to divide the target body 352. It can also be divided into the first region R1 to the third region R3. FIG. 16C is further another method to divide the target body 352 (circular distribution). It can also be divided into the first region R1 to the third region R3.

Additionally, the electron e can be controlled, such that the electron e has a designated spot size. By adjusting the spot size of the electron e, the area range of the target body 352 of FIG. 11 to FIG. 15 and FIG. 16A to FIG. 16C hit by the electron e can be controlled, so that the X-ray with different energy spectrum distribution can be generated.

Referring to FIG. 5 again, a filter layer 500 may be further disposed, which is disposed at a downstream side of the composite target 350. The filter layer 500 has a k-edge absorption energy, and the k-edge absorption energy is higher than the energy of the low energy photon of the X-ray and lower than the energy of the high energy photon of the X-ray. Therefore, the low energy photon part which is harmful to the human body can be filtered.

Additionally, by using the filter layer 500 of which the atomic number is close to the atomic number of the composite target 350, the k-edge absorption energy close to the composite target 350 can be filtered, and the low energy photon of the X-ray can be filtered at the same time. Thus, the effect of the filter layer 500 on the characteristic radiation spectrum of the X-ray can be reduced. If the filter layer 500 is used with a thin target, a sharper single spectrum can be generated.

In summary, the composite target and the X-ray tube with the composite target of the invention at least have the following advantages:

The composite target has the interposing layer. By the interaction between the electron and the target body, and between the electron and the interposing layer, and the interaction generated from the X-ray and the interposing layer, the X-ray energy spectrum distribution is changed.

Also, by the protective layer which can protect the composite target from excessive bombardment of the electron, the composite target has a sufficient long life. Additionally, by the setting method of a plurality of film layers of the target body and by changing the position where the electron enters the target, the X-ray with a designated energy spectrum distribution can be chosen.

The X-ray tube with the above composite target can provide a variety of X-ray energy spectrum distributions.

Additionally, the composite target can also be used to the related applications of the X-ray, not limited to the X-ray tube of the invention.

Although the invention has been described with reference to the above embodiments, it will be apparent to one of ordinary skill in the art that modifications to the described embodiments may be made without departing from the spirit of the invention. Accordingly, the scope of the invention is defined by the attached claims not by the above detailed descriptions.

What is claimed is:

1. A composite target, being interacted with an electron to generate an X-ray, and an energy of the electron is capable of being changed by controlling a tube voltage at least, and the composite target comprising:

a target body;

an interposing layer, connected with the target body; and a protective layer, disposed at an upstream side of the composite target, and the protective layer facing the electron, a critical energy of electron sputtering of the protective layer is more than a critical energy of electron sputtering of the target body, wherein the interposing layer moves a highest peak of an energy spectrum of the X-ray toward a high energy direction, a low energy photon of the X-ray is filtered by the interposing layer, and the low energy photon of the X-ray is capable of being increased by increasing a thickness of the interposing layer, as the tube voltage is enhanced, an amount of a high energy photon of the X-ray generated is increased.

2. The composite target according to claim 1, wherein a material of the interposing layer is selected from the group consisting of copper, silver, gold, indium, nickel, tin, aluminum, diamond, bismuth, antimony, tungsten, molybdenum, tantalum, zinc, cobalt, and a combination thereof.

3. The composite target according to claim 1, wherein the target body at least comprises:

a first film layer; and a second film layer, disposed at one side of the first film layer, wherein the electron is capable of being interacted with the first film layer and the second film layer, so as to choose the X-ray with a designated energy spectrum distribution.

4. The composite target according to claim 1, wherein the target body at least comprises:

a first film layer; and a second film layer, disposed at one side of the first film layer, wherein the second film layer and the first film layer are staggered stacked, the electron is capable of being interacted with the first film layer, and a stacking location of the first film layer and the second film layer respectively, so as to choose the X-ray with a designated energy spectrum distribution.

5. The composite target according to claim 1, wherein the target body at least comprises:

a first film layer; and a second film layer, the first film layer and the second film layer having a tilt interface therebetween, wherein a position of the electron relative to the tilt interface is adjusted such that the electron is interacted with the first film layer and the second film layer, so as to choose the X-ray with a designated energy spectrum distribution.

6. The composite target according to claim 1, wherein the target body at least comprises:

a first film layer; and a second film layer, disposed at one side of the first film layer, wherein the first film layer and the second film layer are stepped stacked, the electron is capable of being interacted with a stacking location of the first film layer and the second film layer, and the second film layer respectively, so as to choose the X-ray with a designated energy spectrum distribution.

7. The composite target according to claim 1, wherein the target body at least comprises:

a first film layer; and a second film layer, disposed at one side of the first film layer, wherein a groove with a designated shape is formed in the first film layer and the second film layer, the groove is capable of being penetrated by the electron, and the electron is capable of being interacted with a stacking location of the first film layer and the second film layer, so as to choose the X-ray with a designated energy spectrum distribution.

8. The composite target according to claim 1, wherein the target body is divided into at least a first region and a second region, the first region and the second region having an interface therebetween, the electron is capable of being interacted with the first region and the second region respectively, so as to choose the X-ray with a designated energy spectrum distribution.

9. The composite target according to claim 1, wherein a material of the target body is selected from the group consisting of scandium, titanium, vanadium, chromium, manganese, iron, cobalt, nickel, copper, zinc, germanium, yttrium, niobium, molybdenum, ruthenium, rhodium, palladium, silver, tin, barium, lanthanum, cerium, neodymium, gadolinium, terbium, dysprosium, holmium, erbium, thulium, ytterbium, lutetium, hafnium, tantalum, tungsten, rhenium, iridium, platinum, gold, thorium, uranium, and a combination thereof.

10. The composite target according to claim 1, further comprising:

a filter layer, disposed at a downstream side of the composite target, the filter layer having a k-edge absorption energy, and the k-edge absorption energy being higher than an energy of the low energy photon of the X-ray, and lower than an energy of the high energy photon of the X-ray.

11. The composite target according to claim 1, wherein a thickness of the target body is $1/7 \sim 1/3$ times a maximum electron penetration depth of a material of the target body.

12. The composite target according to claim 1, wherein a thickness of the target body is 3~10 times a maximum electron penetration depth of a material of the target body.

13. The composite target according to claim 1, wherein a thickness of the target body is 10~30 times a maximum electron penetration depth of a material of the target body.

14. An X-ray tube, comprising:

a casing;

an anode, disposed at the casing, and a composite target being disposed on the anode, the composite target being interacted with an electron to generate an X-ray, and an energy of the electron is capable of being changed by controlling a tube voltage at least, and the composite target comprising:

a target body; and an interposing layer, connected with the target body, wherein the interposing layer moves a highest peak of an energy spectrum of the X-ray toward a high energy direction, a low energy photon of the X-ray is filtered by the interposing layer, the low energy photon of the X-ray is capable of being increased by increasing a thickness of the interposing layer, and as the tube voltage is enhanced, an amount of a high energy photon of the X-ray generated is increased;

a cathode, disposed in the casing, and the cathode is configured to provide the electron;

a power source, connected between the cathode and the anode; and a protective layer, disposed at an upstream side of the composite target, and the protective layer facing the electron, a critical energy of electron sputtering of the protective layer is more than a critical energy of electron sputtering of the target body.

15. The X-ray tube according to claim 14, further comprising:

an electron track moving device, being configured to adjust a position where the electron enters the composite target.

16. The X-ray tube according to claim 15, wherein the electron track moving device comprising:

a main body; and at least four electromagnets, correspondingly disposed on the main body.

17. The X-ray tube according to claim 15, wherein the electron track moving device is a magnet, and the magnet performs a uniaxial movement and the electron performs a uniaxial movement by rotating the magnet.

18. The X-ray tube according to claim 14, wherein a material of the interposing layer is selected from the group consisting of copper, silver, gold, indium, nickel, tin, aluminum, diamond, bismuth, antimony, tungsten, molybdenum, tantalum, zinc, cobalt, and a combination thereof.

19. The X-ray tube according to claim 14, wherein the target body at least comprises:

a first film layer; and a second film layer, disposed at one side of the first film layer, wherein the electron is capable of being interacted with the first film layer and the second film layer, so as to choose the X-ray with a designated energy spectrum distribution.

20. The X-ray tube according to claim 14, wherein the target body at least comprises:

a first film layer; and a second film layer, disposed at one side of the first film layer, wherein the second film layer and the first film layer are staggered stacked, the electron is capable of being interacted with the first film layer, the second film layer, and a stacking location of the first film layer and the second film layer respectively, so as to choose the X-ray with a designated energy spectrum distribution.

21. The X-ray tube according to claim 14, wherein the target body at least comprises:

a first film layer; and a second film layer, the first film layer and the second film layer having a tilt interface therebetween, wherein a position of the electron relative to the tilt interface is adjusted such that the electron is interacted with the first film layer and the second film layer, so as to choose the X-ray with a designated energy spectrum distribution.

22. The X-ray tube according to claim 14, wherein the target body at least comprises:

a first film layer; and a second film layer, disposed at one side of the first film layer, wherein the first film layer and the second film layer are stepped stacked, the electron is capable of being interacted with a stacking location of the first film layer and the second film layer, and the second film layer respectively, so as to choose the X-ray with a designated energy spectrum distribution.

23. The X-ray tube according to claim 14, wherein the target body at least comprises:

a first film layer; and a second film layer, disposed at one side of the first film layer, wherein a groove with a designated shape is formed in the first film layer and the second film layer, the groove is capable of being penetrated by the electron, and the electron is capable of being interacted with a stacking location of the first film layer and the second film layer, so as to choose the X-ray with a designated energy spectrum distribution.

24. The X-ray tube according to claim 14, wherein the target body is divided into at least a first region and a second region, the first region and the second region having an interface therebetween, the electron is capable of being interacted with the first region and the second region respectively, so as to choose the X-ray with a designated energy spectrum distribution.

25. The X-ray tube according to claim 14, wherein a material of the target body is selected from the group consisting of scandium, titanium, vanadium, chromium, manganese, iron, cobalt, nickel, copper, zinc, germanium, yttrium, niobium, molybdenum, ruthenium, rhodium, palladium, silver, tin, barium, lanthanum, cerium, neodymium, gadolinium, terbium, dysprosium, holmium, erbium, thulium, ytterbium, lutetium, hafnium, tantalum, tungsten, rhenium, iridium, platinum, gold, thorium, uranium, and a combination thereof.

26. The X-ray tube according to claim 14, further comprising:

a filter layer, disposed at a downstream side of the composite target, the filter layer having a k-edge absorption energy, and the k-edge absorption energy being higher than an energy of the low energy photon of the X-ray, and lower than an energy of the high energy photon of the X-ray.

27. The X-ray tube according to claim 14, wherein a thickness of the target body is $1/7 \sim 1/3$ times a maximum electron penetration depth of a material of the target body.

28. The X-ray tube according to claim 14, wherein a thickness of the target body is 3~10 times a maximum electron penetration depth of a material of the target body.

29. The X-ray tube according to claim 14, wherein a thickness of the target body is 10~30 times a maximum electron penetration depth of a material of the target body.

* * * * *